US011031730B2

(12) United States Patent
Mitter et al.

(10) Patent No.: US 11,031,730 B2
(45) Date of Patent: Jun. 8, 2021

(54) FLOATING CONNECTOR

(71) Applicant: ODU GmbH & Co. KG, Mühldorf (DE)

(72) Inventors: Alfred Mitter, Heldenstein (DE); Jorge Saucedo, Imperial, CA (US)

(73) Assignee: ODU GmbH & Co. KG, Mühldorf (DE)

( * ) Notice: Subject to any disclaimer, the term of this patent is extended or adjusted under 35 U.S.C. 154(b) by 0 days.

(21) Appl. No.: 16/383,068

(22) Filed: Apr. 12, 2019

(65) Prior Publication Data

US 2020/0119493 A1 Apr. 16, 2020

(30) Foreign Application Priority Data

Oct. 16, 2018 (DE) ..... 20 2018 105 926.2

(51) Int. Cl.

| | |
|---|---|
| ***H01R 13/64*** | (2006.01) |
| ***H01R 13/631*** | (2006.01) |
| ***H01R 13/08*** | (2006.01) |
| ***H01R 13/502*** | (2006.01) |

(52) U.S. Cl.

CPC ..... *H01R 13/6315* (2013.01); *H01R 13/08* (2013.01); *H01R 13/502* (2013.01)

(58) Field of Classification Search

CPC ... H01R 13/6315; H01R 13/502; H01R 13/08
USPC ..... 439/246, 247, 248
See application file for complete search history.

(56) References Cited

U.S. PATENT DOCUMENTS

| | | | | |
|---|---|---|---|---|
| 4,030,797 | A | 6/1977 | Nieman | |
| 6,695,632 | B2 * | 2/2004 | Matsumoto | H01R 13/6485 439/246 |
| 6,773,296 | B2 * | 8/2004 | Kihira | H01R 13/5833 174/93 |
| 6,976,862 | B1 * | 12/2005 | Ormazabal Ocerin | H01R 13/18 439/246 |

(Continued)

FOREIGN PATENT DOCUMENTS

| | | |
|---|---|---|
| CN | 203617485 U | 5/2014 |
| CN | 105655806 A | 6/2016 |

(Continued)

*Primary Examiner* — Abdullah A Riyami
*Assistant Examiner* — Nelson R. Burgos-Guntin
(74) *Attorney, Agent, or Firm* — Harris Beach PLLC; Laura W. Smalley

(57) ABSTRACT

An improved floating connector can be employed for, among other things, connecting a traction battery to the drive of an electrically-driven vehicle. The self-aligning floating connector can be used to mate connectors of the battery and the electric drive despite misalignment. The floating connector has a frame and a contact housing movable inside an aperture of the frame. The contact housing is rotatable about an axis that extends perpendicularly to the surface defined by the aperture. The essentially oval outer surface of the contact housing can cooperate with the aperture to provide a limit stop for the relative movement of the contact housing and the frame. The angular movement of the contact housing inside the aperture can be sterically constrained to limit the rotation of the contact housing relative to the frame to a pre-defined angular range. A system with a floating connector and a mating connector is also disclosed.

21 Claims, 5 Drawing Sheets

(56) References Cited

U.S. PATENT DOCUMENTS

| | | | | |
|---|---|---|---|---|
| 8,408,927 | B2 * | 4/2013 | Tashiro | H01R 4/70 439/247 |
| 2001/0051452 | A1 * | 12/2001 | Walker | F16L 5/00 439/248 |
| 2006/0105603 | A1 * | 5/2006 | Nishio | H01R 13/6315 439/247 |
| 2006/0194464 | A1 * | 8/2006 | Moreno | B25F 5/00 439/248 |
| 2009/0124105 | A1 * | 5/2009 | Lindsay | H01R 13/629 439/246 |
| 2012/0040553 | A1 * | 2/2012 | Tashiro | H01R 4/70 439/359 |
| 2014/0017936 | A1 | 1/2014 | Hozumi et al. | |
| 2016/0268736 | A1 | 9/2016 | Goto et al. | |

FOREIGN PATENT DOCUMENTS

| | | | |
|---|---|---|---|
| CN | 107887758 | A | 4/2018 |
| DE | 102015208965 | A1 | 11/2016 |
| EP | 2555342 | B1 | 7/2018 |
| FR | 1432764 | A | 3/1966 |
| GB | 1235349 | A | 6/1971 |
| JP | 2002367721 | A | 12/2002 |
| JP | 2004220978 | A | 8/2004 |
| JP | 2005093424 | A | 4/2005 |
| JP | 2014137913 | A | 7/2014 |
| JP | 2016009576 | A | 1/2016 |
| JP | 2016140186 | A | 8/2016 |
| JP | 2018073744 | A | 5/2018 |
| KR | 101595188 | B1 | 2/2016 |
| WO | WO-2008027667 | A2 | 3/2008 |

* cited by examiner

FLOATING CONNECTOR

CROSS-REFERENCE TO RELATED APPLICATIONS

This application claims priority to German Patent Application DE 20 2018 105 926.2 U1, filed on Oct. 16, 2018, the disclosure of which is incorporated in this application in its entirety.

FIELD OF THE INVENTION

The invention relates to a floating connector comprising a frame and a contact housing that is movable inside an aperture of the frame in a surface defined by the aperture. The invention further relates to a system comprising a floating connector and a mating connector that can connect with the floating connector to establish an electrical contact.

BACKGROUND OF THE INVENTION

From U.S. Pat. No. 4,030,797: A an electrical connector is known that includes a housing with a tube-like plug shell mounted inside the housing in a manner to translate in either or both of two different directions, to rotate about the housing axis, and to tilt about the housing axis. The plug shell has a flared end portion to receive a receptacle. The plug shell carries a socket in a throat portion thereof, and the receptacle carries one or more pins to be mated to the socket. The purpose of the plug shell being capable of moving relatively to the housing is to provide for proper mating even in cases of misalignment of the housing and the receptacle.

Similarly, UK 1235349 B discloses a socket of a multipole electrical plug and socket connector, in which the socket is positioned in a housing so as to be capable of limited movement in all directions in a plane at a right angle to the socket axis. The socket is positioned by initially stressed springs acting between the housing and the socket. The radial movements of the socket relative to the housing are limited by lugs integral with the housing and engaging in recesses of the socket.

A movable charging connector is known from EP 2555342 B1: It comprises a movable socket device and a plug device, wherein the movable socket device is fixedly provided on a movable mounting plate. Four corners of the mounting plate are riveted to four corners of a base plate via four said tension springs, respectively. When the plug device and the movable socket device are connected with each other, the movable mounting plate and the tension spring cooperate with each other such that the movable socket device can be moved in any direction.

US 2014/0017936 A1 discloses a vehicle-side electrical connector that is mounted on a base bracket via mounting members formed of rubber. Elastic deformation of the mounting members permits a relative displacement of a base bracket and the vehicle-side connector in a compressing direction as well as a relative positional displacement in a sliding direction. The purpose of this arrangement is to achieve self-correction by elastic deformation of the mounting members when there is a positional displacement or inclination between the vehicle-side electrical connector and a battery-side electrical connector.

A coupling element for a vehicle battery is disclosed in DE 102015208965 A1. It comprises a carrier frame with a connector carrier. The connector carrier is supported in the carrier frame by several leaf springs.

FR 1432764 B discloses a battery charger comprising charging sockets that have an outer flange to which a pair of parallel rubber rings are attached in order to provide for a flexible mounting of the socket. This is intended to facilitate insertion of a plug into the socket, even if there is a misalignment between the plug and the socket.

From WO 2008/027667 A2 flexible clip-on shielding and/or grounding strips are known, which can be clipped onto and disposed along a curved edge portion of a mounting surface. The flexible clip-on shielding includes an array of generally transversely extending slots, which slots define finger elements.

Object of the Invention

It is an object of the present invention to provide an improved floating connector comprising a frame and a contact housing that is movable inside an aperture of the frame in a surface defined by the aperture. It is another object of the present invention to provide an improved system comprising a floating connector and a mating connector that can connect with the floating connector to establish an electrical contact.

In particular, the present invention aims at providing a floating connector and a system comprising a floating connector and a mating connector that can be employed for connecting a traction battery to the drive of an electrically driven vehicle. In one aspect, the invention can facilitate connecting the battery's connector with the drive's mating connector in a situation where alignment of the connectors is difficult. Such difficulties can, for example, arise if alignment requires a precise positioning of the battery, which is difficult to achieve due to the battery's mass and/or its location in the vehicle.

Solution According to the Invention

According to a first aspect of the invention, the problem is solved by a floating connector with the features of claim 1. The floating connector comprises a frame and a contact housing that is movable inside an aperture of the frame in a surface defined by the aperture. The contact housing is moreover rotatable about an axis that extends perpendicularly to the surface defined by the aperture. The contact housing has an essentially cylindrical outer surface with the cylinder axis extending perpendicularly to the surface defined by the aperture. The shape of the outer surface of the contact housing is essentially ovally cylindrical.

It is an achievable advantage of this aspect of the invention that the essentially oval outer surface of the contact housing can cooperate with the aperture to provide a limit stop for the relative movement of the contact housing and the frame. Thus the angular movement of the contact housing inside the aperture can be sterically constrained to limit the rotation of the contact housing relatively to the frame to a pre-defined angular range. It is another achievable advantage of the essentially oval outer surface of the contact housing that it can provide for or assist a rotational alignment of the contact housing and a mating connector.

In the context of the present invention, a "floating connector" is a connector that allows a relative movement between a part of the floating connector for coupling to a mating connector and a part of the floating connector for attaching the floating connector to a cable, a support or the like. Due to the relative movement, the floating connector can adapt to the position of the mating connector when mating so that the mating connector must be aligned only within a certain margin to the part of the floating connector that is attached to the cable, the support or the like.

"Movable in the surface" means that the contact housing can move along at least a part of a curve, preferably any curve, which extends in the surface defined by the aperture. The "surface defined by the aperture" in the context of the present invention refers to a surface that spans the aperture, i.e., that extends across the aperture.

In the context of the present invention, a "cylindrical surface" is a surface consisting of all the points of all the straight lines which are parallel to a given straight line and which pass to a fixed plane curve in a plane not parallel to the given straight line. The term "oval" in the context of the present invention refers to a simple smooth (i.e., the equation of the curve is differentiable at all points) convex closed plane curve. Examples of ovals are Cassini ovals, elliptic curves, super-ellipses and Cartesian ovals. The preferred oval has at least one axis of symmetry. The curvature of the oval preferably has two maxima alternating with two minima Accordingly, an "ovally cylindrical surface" is a cylindrical surface in which the fixed plane curve is an oval as defined here.

"Essentially cylindrical" and "essentially oval" means that the cylinder and oval may in one or more parts deviate from a strictly cylindrical or oval form as long as this does not affect the functioning of the invention. Typically, such deviation may be present for technical reasons, such as to accommodate fastening means. For example, protrusions on the contact housing can co-operate with corresponding recesses in the aperture or the frame, in order to ensure that the function of this aspect of the invention, that is, to limit to a pre-defined angular range the rotation of the contact housing relatively to the frame about an axis that extends perpendicularly to the surface defined by the aperture, is not affected.

In a second aspect of the invention, the problem is solved by a floating connector with the features of claim 3. The floating connector comprises a frame and a contact housing that is movable inside an aperture of the frame in a surface defined by the aperture. The frame is mounted, preferably fixedly mounted, onto a support. The floating connector is provided with one or more sliding contact(s) in order to establish an electrical contact between at least part of the contact housing and at least part of the support.

It is an achievable advantage of this aspect of the invention that the contact housing can act as a shield for the contact(s) which it houses, because by means of the sliding contact the contact housing can be grounded to the support. Advantageously, the sliding contact can provide for grounding in a simple and reliable manner in a situation where the contact housing is movable relatively to the support.

In yet another aspect of the invention, the problem is solved by a system with the features of claim 14. The system comprises a floating connector and a mating connector that can be joined with the floating connector to establish an electrical contact. The floating connector comprises a contact housing with an essentially cylindrical outer surface and the mating connector comprises a hollow contact enclosure with an essentially cylindrical inner surface. The floating connector's contact housing and the mating connector's contact enclosure are shaped and arranged such that the contact housing is inserted into the contact enclosure when the floating connector and the mating connector are joined to establish an electrical contact.

It is an achievable advantage of this aspect of the invention that the floating connector's contact housing—and with it the connector(s) inside the contact housing—is protected from contaminations such as liquids or dirt particles. The system according to this aspect of the invention is of particular advantage in situations where the floating connector's contact housing is inserted into the mating connector's contact enclosure from the bottom, i.e., the mating connector when mated is on top of the floating connector. Herein, "top" and "bottom" are defined with reference to the direction of gravity.

The floating connector and the system according to the invention can, for example, be used for connecting a traction battery of an electrical driven vehicle, such as an electrical car, with the vehicle's electric drive. The electric drive typically comprises electric leads to conduct electricity from the battery to the electric motor and other components of the electric drive. Drive batteries typically have a considerable mass, which makes their handling difficult. Moreover, batteries typically are located in parts of the car that are not easily accessible. This can make it difficult to align the battery's connector and a corresponding connector of the vehicle's electric drive when the battery is inserted into the vehicle. Yet, if one of the connectors is a floating connector according to the present invention, the self-aligning property of the floating connector can be exploited for mating the connectors despite misalignment.

Preferred Embodiments of the Invention

Preferred features of the invention, which may be applied alone or in combination, are discussed in the following and in the dependent claims.

In a preferred embodiment of the invention, the contact housing is rotatable about an axis that extends perpendicularly to the surface defined by the aperture. It is an achievable advantage of this embodiment of the invention that the floating connector can compensate for a certain degree of angular misalignment between the floating connector and a mating connector. Preferably, the aperture has a non-circular shape, for example an essentially oval shape. The preferred contact housing has an essentially ovally cylindrical outer surface with the cylinder's axis extending perpendicularly to the surface defined by the aperture.

Preferably, the shape and size of the aperture and the contact housing's perimeter in the surface of the aperture are chosen to limit to a pre-defined angular range the rotation of the contact housing relatively to the frame about an axis that extends perpendicularly to the surface defined by the aperture. By means of limiting to a pre-defined angular range the rotation of the contact housing relatively to the frame, damage to the floating connector can be avoided. The preferred pre-defined angular range is less than 120° (based on a 360° full circle), more preferably less than 90°, more preferably less than 60°, more preferably less than 45°, more preferably less than 30°. The pre-defined angular range preferably is more than 5°, more preferably more than 10°, more preferably more than 15°, for example 20°.

The preferred frame is mounted, preferably fixedly mounted, onto a support. Preferably, a gap is provided between the frame and the support. The preferred gap is open towards the aperture. The preferred contact housing is provided with a flange, which flange preferably extends into the gap. Advantageously, with this embodiment of the invention, the flange can be guided in the gap, thereby constraining the translational movement to movements in the surface defined by the frame.

In a preferred embodiment of the invention, the contact housing can be moved translationally in the surface defined by the frame. Preferably, the contact housing is prevented from translational movement in a direction outside the surface of the frame. Preferably, the contact housing is prevented from any rotational movement about an axis other than an axis that extends perpendicularly on the surface defined by the frame.

In a preferred embodiment of the invention, the surface defined by the aperture is the smallest surface that spans the aperture. Particularly preferably, the surface defined by the frame is a flat surface. Alternatively, the surface is concave or convex, for example a spherical segment. In the case of a flat surface, the floating connector can advantageously compensate for a lateral misalignment of the floating connector's frame and a mating connector. In the case of the surface being a spherical segment, the floating connector can compensate for an angular displacement of the floating connector and the mating connector with regard to a centre of the sphere of the spherical segment.

In a preferred embodiment of the invention, the floating connector is provided with one or more sliding contact(s) in order to establish an electrical contact between at least part of the contact housing and at least part of the support. Such sliding contact preferably is an electrical contact attached to one of the flange and the support and elastically biased against the other. It may for example be a spring contact of an elastic metal strip or wire. For example, the flexible strip disclosed in WO 2008/027667 A2 or a variation thereof could be used as a contact. The sliding contact could also be a spring-loaded pin as, for example, disclosed in DE 19945176 B4. With this embodiment of the invention, advantageously, the contact housing can act a shield for the contact(s) inside the contact housing, because by means of the sliding contact the contact housing can be grounded to the support.

The preferred floating connector comprises more than three, more preferably more than 6, more preferably more than 12, more preferably more than 24 sliding contacts. The contacts preferably are arranged—regularly or in one or more sections—in a row. The preferred row is a closed curve, for example an oval or a circle.

The preferred sliding contacts are fingers of a flexible metal strip, which on one long side is provided with a row of fingers extending in transverse direction of the strip. The individual fingers preferably are formed by means of transverse slots or incisions on this long side of the strip. Typically, a finger is longer than 3 mm (millimetres), more preferably longer than 4 mm. The preferred finger is shorter than 20 mm, more preferably shorter than 10 mm. The preferred finger is wider than 1 mm, more preferably wider than 2 mm. The preferred finger is narrower than 10 mm, more preferably narrower than 5 mm Preferably, at the other long side, the metal strip is attached to the contact housing (more preferably the flange of the contact housing) or the support. As a result, the fingers can resiliently press against the other of the elements contact housing and support. For attaching the strip, the flange or the contact housing can be provided with a groove and/or a web, preferably an oval or circular groove and/or web. Also for attaching the strip to the groove and/or the web, the strip may be bent one or more times about one or more axes extending in the longitudinal direction of the strip.

The preferred frame is electrically non-conductive, or electrically insulated from the support by means of an electrically non-conducting material. The preferred contact housing comprises an electrically conductive shell. Preferably, the floating connector is electrically connected to the shell. Preferably, the flange is electrically conductive or comprises an electrically conductive part. The electrically conductive flange or flange part is preferably electrically connected to the shell; more preferably, it is formed integrally with the shell.

In a preferred embodiment of the invention, the sliding contact(s) is/are part of or attached to the flange, preferably the electrically conducting part of the flange, and the sliding contact(s) slide(s) on the support when the contact housing is moved relatively to the support. In another preferred embodiment, the sliding contacts(s) is/are attached to the support, and the sliding contact(s) slide(s) on the flange, preferably the electrically conductive part of the flange, when the contact housing is moved relatively to the support. The floating connector may comprise two, three or more sliding contacts. Some of these contacts may be attached to the flange and sliding on the support and others may be attached to the support and sliding on the flange.

The preferred floating connector comprises an elastic bellow. The preferred bellow extends between the frame and the contact housing. More preferably, the bellow extends between the frame and the flange. It is an achievable advantage of this embodiment of the invention that the bellow prevents contaminants such as liquids or dirt particles to pass through the aperture of the frame, thereby protecting the inner parts of the floating connector, and preferably also parts of the support, from contamination. In particular, the bellow advantageously can protect the sliding contact(s) from contamination. The preferred bellow is from an elastomer such as silicon rubber, preferably VMQ. Alternative suitable elastomers include NBR, EPDM and FKM.

The preferred bellow material has a hardness of more than Shore-A 20, preferably more than Shore-A 30, preferably more than Shore-A 40. The preferred bellow material has a hardness of less than Shore-A 80, preferably less than Shore-A 70, preferably less than Shore-A 60.

In a preferred floating connector, the elastic bellow biases the contact housing into a neutral position of the contact housing inside the frame. In the context of the present invention, "biasing" into a neutral position means that if the contact housing has been moved, by the application of an external force, in a position other than the neutral position, the bellow drives the contact housing back into the neutral position as soon as the external forces are removed. The position other than the neutral position can be a translation and/or a rotation relatively to the neutral position. It is an achievable advantage of this embodiment of the invention that the elastic bellow can serve a double function, namely preventing contaminants to pass through the aperture of the frame and biasing the contact housing.

In a particularly preferred embodiment of the invention, there are no means for biasing the contact housing into the neutral position other than the elastic bellow. Alternatively, there may be other biasing means such as one or more metal spring(s). Yet, preferably in such alternative embodiments, when such supplementary biasing means are removed, the spring constant of the elastic bellow is still sufficient to bias the contact housing in the neutral position. Even more preferably, when the elastic bellow is removed from such alternative embodiment, the remaining biasing means are insufficient to bias the contact housing into the neutral position.

In a preferred embodiment of the invention, the mating direction of the floating connector extends perpendicularly to the surface defined by the frame. It is an achievable advantage of this embodiment of the invention that the floating connector can compensate for a displacement of the floating connector relatively to a mating connector in a direction perpendicular to the mating direction.

The preferred contact housing comprises at least one contact. In a preferred embodiment of the invention, the contact housing comprises at least one male contact. Preferably, the contact housing is provided with an opening through which he contact is accessible. The opening preferably is provided at a base of the cylindrical contact housing. The preferred contact housing is a right cylinder, ie the base of the cylinder is at a right angle with regard to the cylinder axis. In the contact of the present invention, a male contact has a contact pin with a fully or partially electrically conductive circumferential surface.

In a preferred embodiment of the invention, the contact housing extends at least along the entire length of the contact. If there are multiple contacts, the contact housing preferably extends at least along the entire length of each of the contacts. In other word, the contacts do not extend beyond the rim of the opening of the contact housing. Preferably, the distal end of at least one, preferably all, contacts is provided with an electrically non-conductive cap. This, advantageously, can—preferably jointly with the contact housing—prevent a user of the floating connector from inadvertently touching a conductive part of the contact(s). In a preferred embodiment of the invention, the contact housing's conductive shell extends at least along the entire length of the contact. If there are multiple contacts, the contact housing's conductive shell preferably extends at least along the entire length of each of the contacts. It is an achievable advantage of this embodiment of the invention that the shell can effectively shield the male contact or contacts.

A preferred mating connector that can connect with the floating connector to establish an electrical contact comprises a hollow contact enclosure that has an essentially cylindrical inner surface, more preferably an essentially ovally cylindrical inner surface. Preferably the inner surface of the contact enclosure matches the essentially ovally cylindrical outer surface of the contact housing such that the contact housing can be inserted into the contact enclosure when the floating connector and the mating connector are connected to establish an electrical contact. Advantageously, the contact enclosure can protect the floating connector's contact housing, and with it the connector(s) inside the contact housing, from contaminations such as liquids or dirt particles. The system according to this aspect of the invention is of particular advantage in situations where the floating connector's contact housing is intended for being inserted into the mating connector's contact enclosure from the bottom, ie the mating connector when mated is on top of the floating connector.

The preferred mating connector comprises one or more female contacts that can mate with the male contacts of the floating connector. The female contacts may for example be contacts stamped from sheet metal, for example of the type offered by ODU GmbH & Co KG under the brand name STAMPTAC®. Some or all of the female contacts can be contact sleeves, preferably hollow cylindrical contact sleeves. The contact sleeves may employ as contact elements one or more springs such as the ones disclosed in DE 4227007 A1 or offered by ODU GmbH & Co KG under the brand name SPRINGTAC®. Preferred springs can resiliently contact corresponding male contacts. The contact sleeves may employ as a contact element a lamella basket as for example disclosed in DE 8716204 U1 or EP 2209167 B1 or offered by ODU GmbH & Co KG under the brand name LAMTAC®. In a contact sleeve with a lamella basket, one or more lamellae of the lamella basket can resiliently contact corresponding contact elements such as male contacts to establish an electrical contact. The contact sleeves may be slotted sleeves as offered by ODU GmbH & Co KG under the brand name TURNTAC®, where parts of the sleeves between the slots can resiliently contact corresponding contact elements such as male contacts to establish an electrical contact. Some or all of the sleeves typically extend in parallel to each other. The preferred cylindrical inner surface of the mating connector's contact enclosure is a right cylinder.

Preferably, the contact enclosure comprises an opening for accessing the contact(s). The opening preferably is provided at a base of the cylinder. Moreover, the preferred mating connector is provided with a packing ring in a surface in order to prevent contaminants such as liquids or dirt particles to enter between the contact enclosure and the contact housing when the floating connector and the mating connector are mated.

Preferably, the rim of the opening of the contact enclosure comprises a lead-in chamfer. In an alternative embodiment of the invention, the lead-in chamfer is provided at the rim of the opening of the floating connector's contact housing. The lead-in chamfer on one of the elements contact enclosure and the contact housing can co-operate with the rim of the other element in order to align the contact housing with the contact enclosure and, consequently, the mating connector. The preferred lead-in chamfer has an essentially oval shape. The preferred edge co-operating with the lead-in chamfer preferably has an essentially oval shape. The oval shape advantageously can provide for or assist a rotational alignment of the contact housing and the contact enclosure and, consequently, the mating connector.

In a preferred embodiment of the invention, the battery has one of the components, floating connector and mating connector, fixedly attached to it. Preferably, the component that bears female power contact(s) is attached to the battery. Preferably, the mating connector is fixedly attached to the battery. In the context of the present invention, a "power contact" is a contact that transmits from the battery to the drive the electricity for powering the drive. This is to be distinguished from contacts that are for transmitting controlling signals, for example.

In a preferred embodiment of the invention the vehicle chassis and/or a component of the vehicle drive is provided with one of the components, floating connector and mating connector, fixedly attached to it. The component preferably is the one that bears male power contact(s). Preferably, the floating connector is connected to the vehicle chassis and/or a component of the vehicle drive.

The preferred floating connector and the preferred mating connector are designed to transmit in continuous operation currents of more than 80 A (Ampere), preferably more than 160 A at a voltage of more than 200 V (Volts) preferably more than 400 V. In short term-operation of up to 30 seconds, the preferred floating connector and the preferred mating connector can transmit currents of more than 140 A (Ampere), preferably more than 380 A at a voltage of more than 200 V (Volts) preferably more than 400 V.

BRIEF DESCRIPTION OF THE DRAWINGS

In the following, further preferred embodiments of invention are illustrated by means of examples. The invention is not limited to these examples, however.

The drawings schematically show.

DETAILED DESCRIPTION OF AN EMBODIMENT OF THE INVENTION

Figure 1:
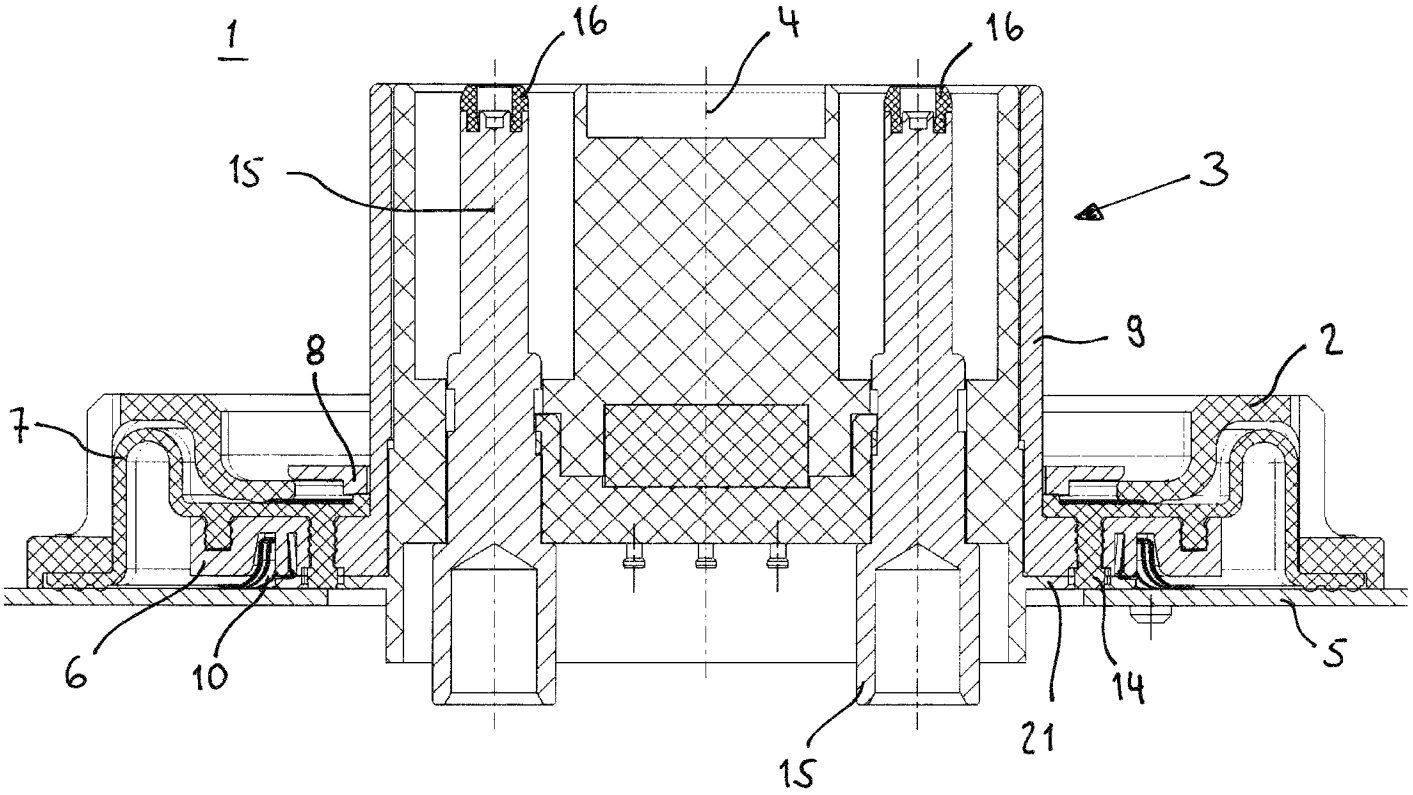
FIG. 1 A cross-sectional view of the floating connector according to the present invention.
Figure 2:
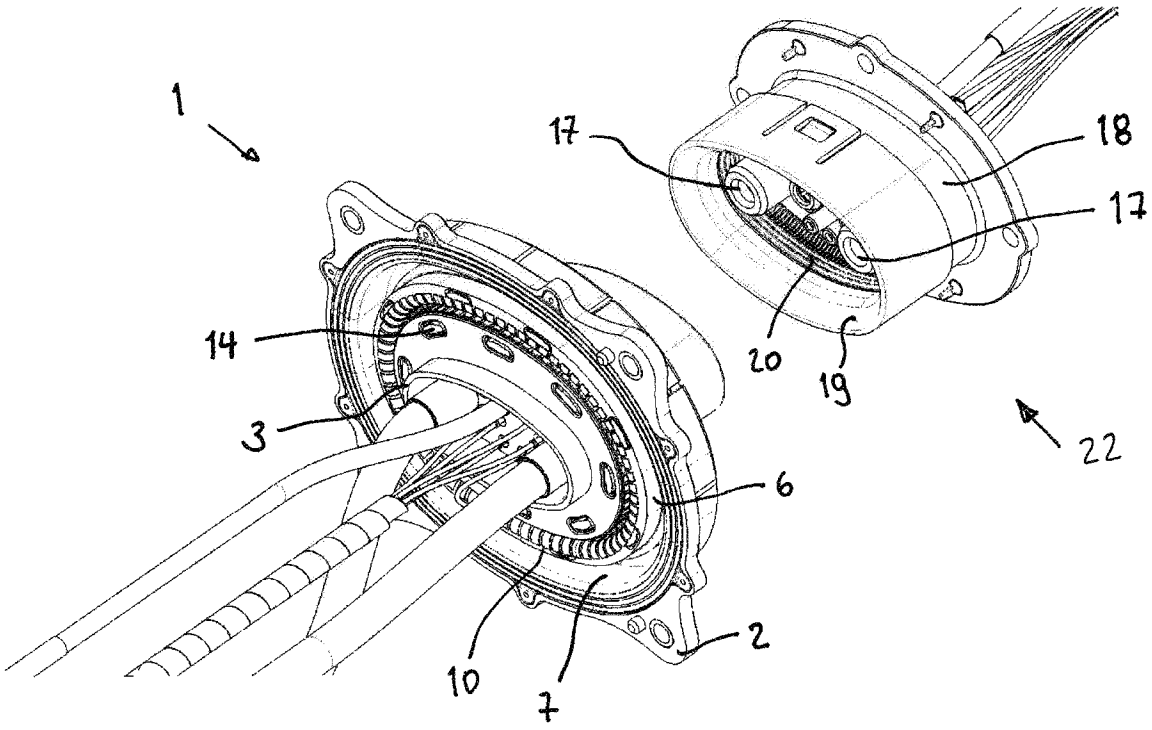
FIG. 2 A perspective view of the floating connector of FIG. 1 on the left and a mating connector on the right.

In the following description of preferred embodiments of the invention, identical reference numerals refer to identical or similar components.

Figure 3:
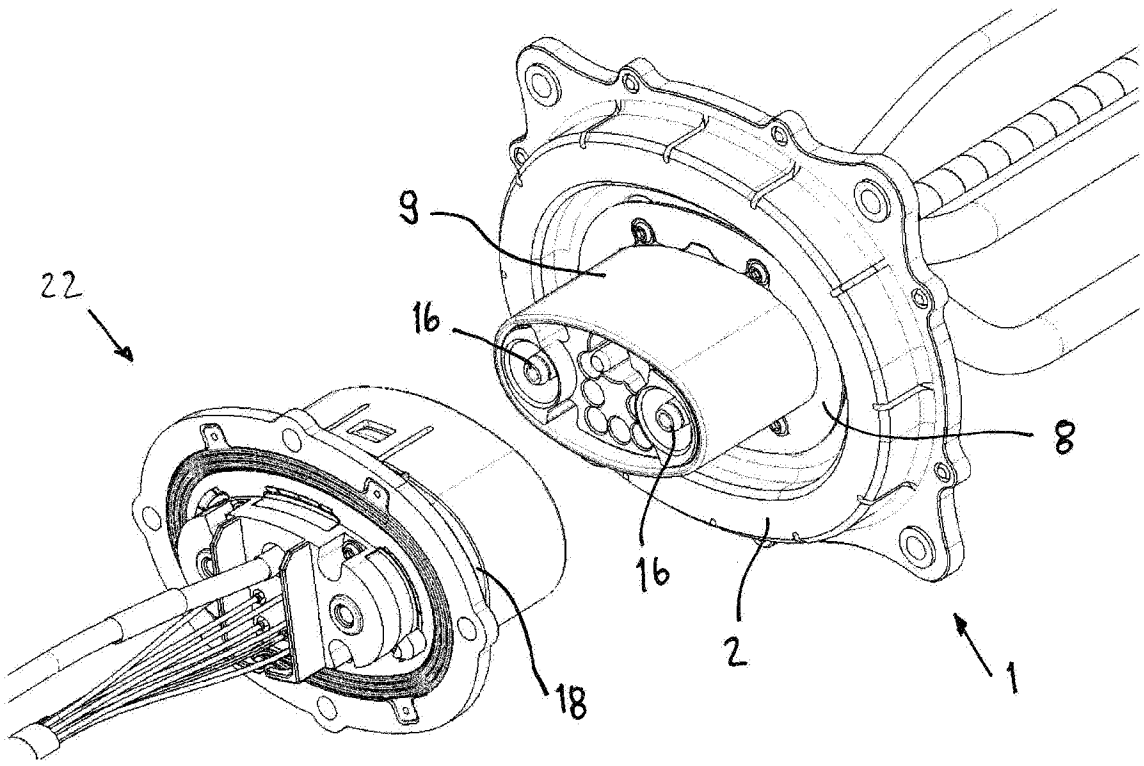
FIG. 3 A perspective view of the mating connector of FIG. 2 on the left and the floating connector of FIGS. 1 and 2 on the right.

An exemplary floating connector 1 according to the invention is shown in the Figures. It comprises a frame 2 with an aperture, in which a contact housing 3 is placed. The contact housing 3 is movable in a plane that is defined by the aperture of the housing 3. It can also be rotated about a central axis 4 of the housing 3, which extends perpendicularly to the surface defined by the frame 2 and coincides with the central axis of the ovally right cylindrical outer surface of the contact housing. As can be best seen in FIG. 3, the frame 2 and its aperture have a non-circular, more precisely oval shape similar to the oval shape of the outer surface of the contact housing 3. As a result, when the contact housing 3 is rotated from its neutral position by a certain amount—about 10° in the present example—in one direction, it touches the edge of the frame 2 that surrounds the aperture, thereby bringing the rotational movement to a halt. Thereby, in the present example rotation of the contact housing 3 inside the aperture is limited to a range of about 20°.

As can best be seen in FIG. 1, the frame 2 is mounted onto an electrically conductive and grounded support 5. Moreover, the contact housing 3 comprises a flange 6 that extends into a gap formed between the frame 2 and the support 5. There is a circumferential bellow 7 that extends from the contact housing 3 to the frame 2. The bellow 7 is from VMQ silicon rubber.

On the side of the contact housing 3, the inner side of the bellow 7 is attached to the flange 6 at 14, and on the side of the frame 2, the outer side of the bellow 7 is clamped between the flange 2 and the support 5. An oval blind 8 is provided that extends across the larger part of the aperture between the contact housing 3 and the frame 2. The blind 8 prevents the contact housing 3 from falling below the frame 2 when the floating connector 1 is not yet mounted onto the support 5. The blind 8 can also protect the bellow 7. In order to accommodate screws (three out of four can be seen in FIG. 3) for attaching the blind 8 to the contact housing 3, the otherwise oval contact housing 3 is provided with ears (not shown) that correspond to recesses (one such recess is hinted at near the top left screw in FIG. 3) in the otherwise oval frame.

Once the floating connector 1 is mounted onto the support 5, due to the contact housing's 3 flange 6 being borne between the frame 2 and the support 5, the translational motion of the contact housing 3 is constrained to motions inside the plane defined by the frame 2. The elastic bellow 7 biases the contact housing into a neutral position that is at the centre of the aperture of the frame 2. In the neutral position, the contact housing's 3 outer surface is concentric with the aperture, and the central axis of the oval of the contact housing's 3 outer surface coincides with that of the oval of the aperture. If the contact housing 3 is moved by external forces in a position other than this neutral position, the bellow 7 drives the contact housing 3 back into the neutral position as soon as the external forces are removed.

Figure 6:
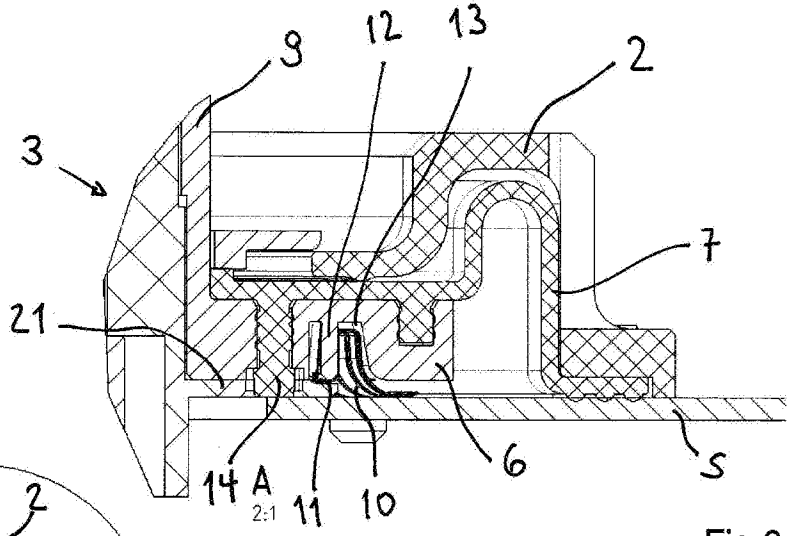
FIG. 6 A detail view of the flange, the sliding contact and the bellow of the floating connector of the previous Figures.
Figure 5:
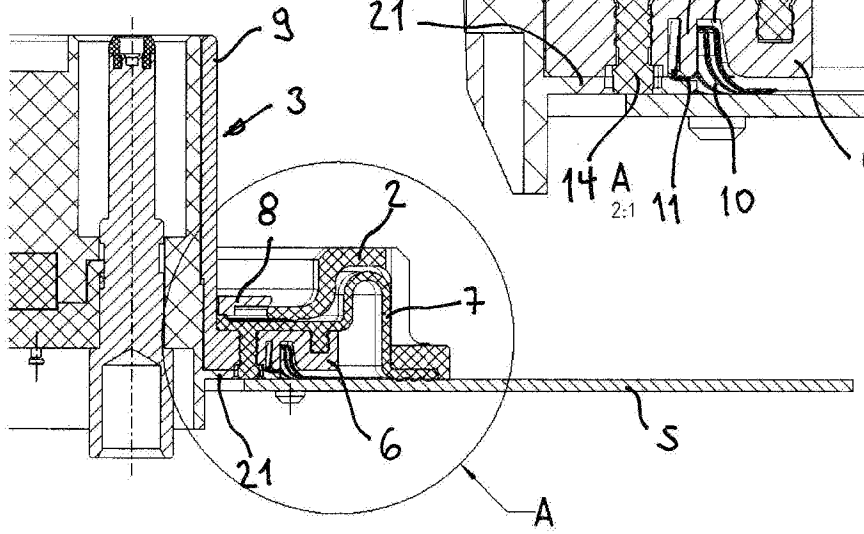
FIG. 5 A partial cross-sectional view of the floating connector of the previous Figures indicating the location of a detail shown in FIG. 6.

As can also be seen best in FIG. 1, the flange 6 is formed in one piece with a shell 9 of the contact housing 3. The shell 9 and the flange 6 are from an electrically conductive material such as aluminium and the flange 6 is provided with circumferential sliding contacts 10 that contact the surface of the support 5 that faces the flange 6. As the support 5 is grounded, the shell 9, via the sliding contacts 10 and the flange 6, is likewise grounded. In FIG. 6 a detail of the sliding contacts is shown.

The sliding contacts 10 are a row of fingers formed on one long side of a flexible metal strip 11 by means of transverse slots on this long side of the strip 11. FIG. 6 shows three of these fingers. The cross section of the strip 11 is generally S-shaped. The first bend of the strip engages both sides of a circular web 12 provided in the flange 6. The second bend lies in a circular groove 13 provided in the flange 6, which groove 13 is adjacent to and concentric with the web 12. From the second bend the fingers extend out of the groove 13; they are elastically bent outwardly, thereby forming a third bend, and biased to press against the support 5. Moreover, a spacer 21 ensures that a uniform space is kept between the flange 6 and the support 5. The spacer is formed integrally with an insulating body of the contact housing 3.

The contact housing 3 comprises two male power contact pins 15 that are accessible through an open base of the ovally cylindrical contact housing 3. The distal ends of the pins are provided with electrically non-conducting caps 16. As a result, the contact housing 3 and the caps 16 in combination can prevent a user from inadvertently touching the conductive parts of the pins 15. Moreover, there are several other contact pins (not shown) provided in the part of the contact housing between the two power contact pins 15. These other pins are shorter and can serve for inter alia the transmission of control signals.

Figure 4:
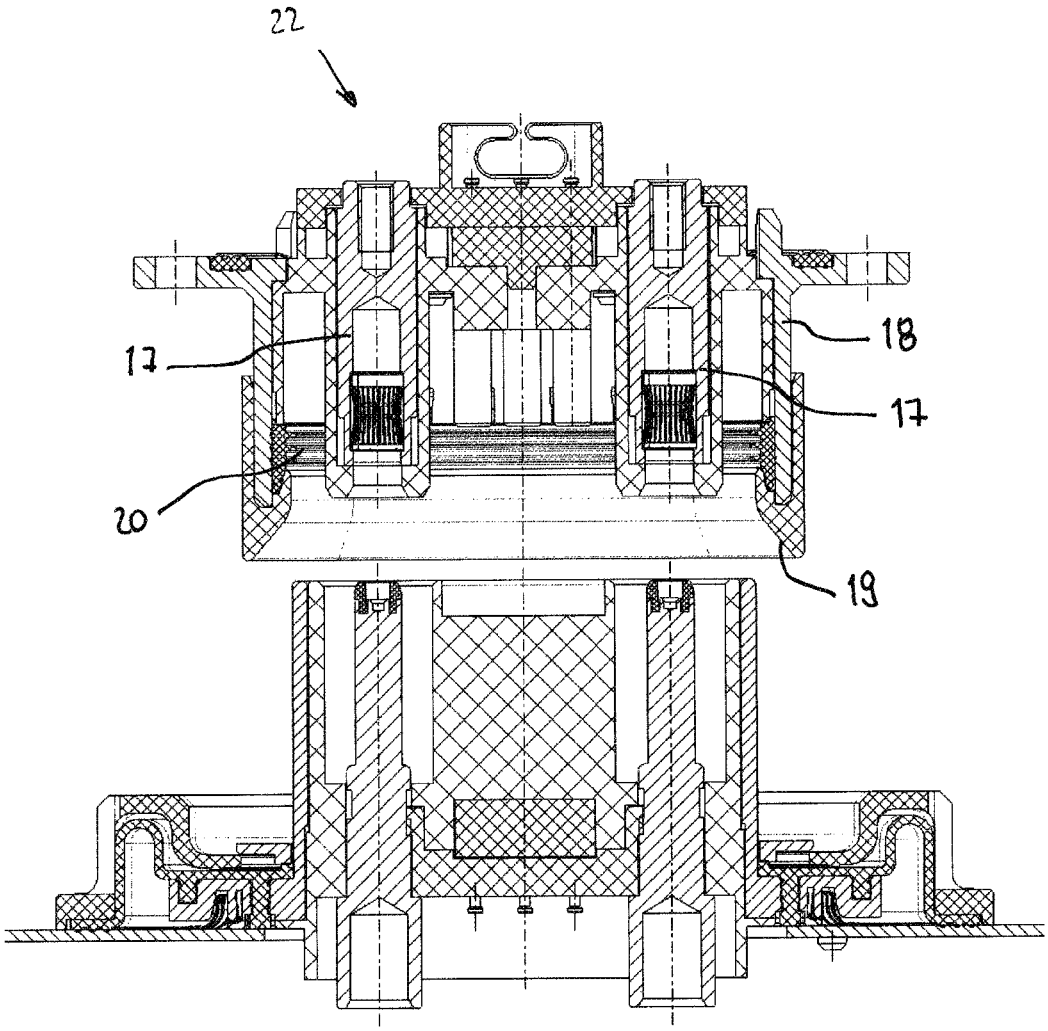
FIG. 4 A cross-sectional view of the mating connector of FIGS. 2 and 3 on top of the floating connectors of FIGS. 1 to 3.

As can be best seen in FIG. 4, the mating connector 22 comprises two sockets 17 that correspond to the pins of the floating connector so that they can establish, via lamella baskets, an electrical contact when the mating connector 22 is mated with the floating connector 1. The mating connector 22 comprises an ovally hollow cylindrical contact enclosure 18 in which the sockets 17 are positioned. The contact enclosure 18 is a right cylinder and open at its base in order to render the sockets 17 accessible to the floating connector's 1 contact pins 15. The rim of the base of the mating connector's contact enclosure 18 is provided with a ring that has an inwards lead-in-chamfer 19. When the mating connector 22 and the floating connector 1 are combined, the chamfer 19 can apply a lateral force to the floating connector's 1 contact housing 3 in order to align the contact housing 3 with the mating connector 22 for mating. When the two connectors mate, the floating connector's 1 contact housing 3 is inserted into the mating connector's 22 contact enclosure 18.

The mating connector 22 is also provided with a packing ring 20 that assists in preventing contaminating liquid or dirt particles to reach the inside of the floating connector 1 and the mating connector 22 from the outside. Thereby, the mating connector 22 and the floating connector 1 cooperate to keep contaminants outside the contact areas and the support 5.

The features as described in the above description, claims and figures can be relevant individually or in any combination to realise the various embodiments of the invention.

The invention claimed is:

1. A floating connector comprising: a frame, and a contact housing that is movable inside an aperture of the frame in a surface defined by the aperture and that is rotatable about an axis that extends perpendicularly to the surface defined by the aperture, wherein the contact housing has an essentially cylindrical outer surface with the cylinder axis extending perpendicularly to the surface defined by the aperture, wherein the shape of the outer surface of the contact housing is essentially ovally cylindrical, and wherein the frame is mounted onto a support, a gap is provided between the frame and the support, which gap is open towards the aperture, and the contact housing is provided with a flange, which flange extends into the gap.

2. The floating connector according to claim 1, wherein the aperture has a non-circular shape, and the shape and size of the aperture and the shape and size of the contact housing's perimeter in the surface of the aperture limit to a pre-defined angular range the rotation of the contact housing relative to the frame about an axis that extends perpendicularly to the surface defined by the aperture.

3. A floating connector comprising:

a frame, a contact housing that is movable inside an aperture of the frame in a surface defined by the aperture, wherein the frame is mounted onto a support, and one or more sliding contact(s) to establish a direct electrical contact between at least part of the contact housing and at least part of the support.

4. The floating connector according to claim 3, wherein a gap is present between the frame and the support, and wherein the gap is open towards the aperture, and the contact housing further comprises with a flange that extends into the gap.

5. The floating connector according to claim 3, wherein the contact housing comprises an electrically conductive shell and the sliding contact is electrically connected to the shell.

6. The floating connector according to claim 1, wherein the contact housing can move translationally in a surface defined by the frame.

7. The floating connector according to claim 1, wherein the surface defined by the frame is flat or a spherical segment.

8. The floating connector according to claim 1, further comprising an elastic bellow that extends between the frame and the contact housing.

9. The floating connector according to claim 8, wherein the elastic bellow biases the contact housing into a neutral position of the contact housing inside the aperture of the frame.

10. The floating connector according to claim 1, wherein the mating direction of the floating connector is perpendicular to the surface defined by the frame.

11. The floating connector according to claim 1, wherein the contact housing comprises at least one male contact and the contact housing further comprises an opening through which the male contact is accessible.

12. The floating connector according to claim 11, wherein the contact housing extends at least along the entire length of the male contact.

13. The floating connector according to claim 12, wherein the contact housing further comprises a conductive shell that extends at least along the entire length of the male contact.

14. A system comprising: a floating connector according to claim 1 and a mating connector that can be joined with the floating connector to establish an electrical contact, wherein the floating connector comprises a contact housing with an essentially cylindrical outer surface and the mating connector comprises a hollow contact enclosure that has an essentially cylindrical inner surface, and wherein the floating connector's contact housing and the mating connector's contact enclosure are shaped and arranged such that the contact housing is inserted into the contact enclosure when the floating connector and the mating connector are joined to establish an electrical contact.

15. The system according to claim 14, wherein the mating connector comprises female contacts and the floating connector comprises male contacts wherein the female contacts of the mating connector can mate with the male contacts of the floating connector.

16. The system according to claim 14, wherein the contact enclosure of the mating connector comprises an opening and the rim of the opening comprises a lead-in chamfer.

17. The floating connector according to claim 3, wherein the contact housing can move translationally in a surface defined by the frame.

18. The floating connector according to claim 3, wherein the surface defined by the frame is flat or a spherical segment.

19. The floating connector according to claim 3, further comprising an elastic bellow that extends between the frame and the contact housing.

20. The floating connector according to claim 19, wherein the elastic bellow biases the contact housing into a neutral position of the contact housing inside the aperture of the frame.

21. The floating connector according to claim 3, wherein the mating direction of the floating connector is perpendicular to the surface defined by the frame.

* * * * *